US008919337B2

(12) United States Patent
Schultz et al.

(10) Patent No.: US 8,919,337 B2
(45) Date of Patent: Dec. 30, 2014

(54) FURNACE PREMIX BURNER

(75) Inventors: Michael W. Schultz, Elk River, MN (US); Douglas Perry, Muncie, IN (US); James E. Erickson, Eagan, MN (US)

(73) Assignee: Honeywell International Inc., Morristown, NJ (US)

( * ) Notice: Subject to any disclaimer, the term of this patent is extended or adjusted under 35 U.S.C. 154(b) by 280 days.

(21) Appl. No.: 13/529,692

(22) Filed: Jun. 21, 2012

(65) Prior Publication Data

US 2013/0213379 A1 Aug. 22, 2013

Related U.S. Application Data

(63) Continuation-in-part of application No. 13/399,942, filed on Feb. 17, 2012.

(51) Int. Cl.
*F24H 3/08* (2006.01)

(52) U.S. Cl.
USPC ..... 126/110 C; 126/110 A; 431/354; 431/12; 165/173

(58) Field of Classification Search
USPC ..... 126/110 C, 110 A, 116 R; 431/354, 12, 9, 431/8; 165/173, 104.34
See application file for complete search history.

(56) References Cited

U.S. PATENT DOCUMENTS

| | | | | |
|---|---|---|---|---|
| 3,080,912 | A | | 3/1963 | Winter |
| 4,945,890 | A | | 8/1990 | Ripka |
| 5,092,761 | A | | 3/1992 | Dinicolantonio |
| 5,375,586 | A | | 12/1994 | Schumacher et al. |
| 5,379,751 | A | | 1/1995 | Larsen et al. |
| 5,439,372 | A | | 8/1995 | Duret et al. |
| 5,736,795 | A | | 4/1998 | Zuehlke et al. |
| 5,899,866 | A | | 5/1999 | Cyrus et al. |
| 5,903,139 | A | | 5/1999 | Kompelien |
| 5,997,285 | A | | 12/1999 | Carbone et al. |
| 6,004,129 | A | | 12/1999 | Carbone et al. |
| 6,062,848 | A | * | 5/2000 | Lifshits ..... 431/285 |
| 6,089,221 | A | | 7/2000 | Mano et al. |
| 6,190,159 | B1 | | 2/2001 | Moore et al. |
| 6,205,041 | B1 | | 3/2001 | Baker |
| 6,314,949 | B1 | | 11/2001 | DeGrazia, Jr. et al. |
| 6,383,462 | B1 | | 5/2002 | Lang |
| 6,490,174 | B1 | | 12/2002 | Kompelien |

(Continued)

FOREIGN PATENT DOCUMENTS

| | | |
|---|---|---|
| EP | 1006274 | 8/2003 |
| GB | 2349456 | 11/2000 |

OTHER PUBLICATIONS

Costello et al., "New Generation of Premix Gas Blowers" 51st Annual International Appliance Technical Conference, Lexington, KY, ebm-papst, Inc., May 2000.
U.S. Appl. No. 14/088,306, filed Nov. 22, 2013.

(Continued)

*Primary Examiner* — Alfred Basichas
(74) *Attorney, Agent, or Firm* — Seager Tufte & Wickhem LLC.

(57) ABSTRACT

A system having a pre-mix burner manifold in a housing that may permit air to be drawn through slots in the housing to flow over an external surface of the manifold. The flow of air may maintain a temperature of the manifold lower than a temperature that the manifold might have without the flow. The manifold may be attached to a burner and heat exchanger.

20 Claims, 11 Drawing Sheets

(56) References Cited

U.S. PATENT DOCUMENTS

| | | | | |
|---|---|---|---|---|
| 6,736,118 | B1 | 5/2004 | Velke | |
| 6,758,208 | B2 | 7/2004 | Gierula et al. | |
| 6,846,175 | B2 | 1/2005 | Spicer | |
| 6,877,980 | B2 | 4/2005 | Stephens et al. | |
| 6,880,548 | B2 | 4/2005 | Schultz et al. | |
| 6,889,686 | B2 | 5/2005 | Specht | |
| 6,923,643 | B2 | 8/2005 | Schultz et al. | |
| 6,938,688 | B2 | 9/2005 | Lengauer, Jr. et al. | |
| 7,476,988 | B2 | 1/2009 | Mulhouse et al. | |
| 7,642,674 | B2 | 1/2010 | Mulhouse et al. | |
| 7,658,183 | B1 | 2/2010 | Johnson | |
| 7,726,386 | B2 | 6/2010 | Specht | |
| 8,110,945 | B2 | 2/2012 | Simard et al. | |
| 8,167,610 | B2 | 5/2012 | Raleigh et al. | |
| 8,417,091 | B2 | 4/2013 | Kim et al. | |
| 8,616,194 | B2 * | 12/2013 | Sherrow et al. | 126/116 R |
| 2005/0194003 | A1 | 9/2005 | Paulsen et al. | |
| 2009/0145419 | A1 | 6/2009 | Hoeve | |
| 2011/0073101 | A1 | 3/2011 | Lau et al. | |
| 2011/0174291 | A1 | 7/2011 | Manohar et al. | |
| 2013/0213378 | A1 | 8/2013 | Schultz | |
| 2013/0302737 | A1 | 11/2013 | Schultz et al. | |

OTHER PUBLICATIONS

U.S. Appl. No. 14/088,312, filed Nov. 22, 2013.
U.S. Appl. No. 14/300,228, filed Jun. 9, 2014.
U.S. Appl. No. 14/300,232, filed Jun. 9, 2014.
U.S. Appl. No. 14/301,175, filed Jun. 10, 2014.
Environmental Protection Agency, "Natural Gas Combustion," 10 pages, Jul. 1998.
http://web.archive.org/web/20101130062956/http://www.thermalloys.com/Eng/TH_FeCrAl.htm, "Thermalloys AB," 1 page, printed Aug. 13, 2013.

* cited by examiner

FURNACE PREMIX BURNER

The present application is a continuation-in-part of U.S. patent application Ser. No. 13/399,942, filed Feb. 17, 2012, and entitled "A Burner System for a Furnace". U.S. patent application Ser. No. 13/399,942, filed Feb. 17, 2012, is hereby incorporated by reference.

BACKGROUND

The present disclosure pertains to burners and particularly to burners for heat exchangers. More particularly, the disclosure pertains to burner manifolds for the heat exchangers.

SUMMARY

The disclosure reveals a system having a pre-mix burner manifold in a housing that may permit air to be drawn through slots in the housing to flow over an external surface of the manifold. The flow of air may maintain a temperature of the manifold lower than a temperature that the manifold might have without the flow. The manifold may be attached to a burner and heat exchanger.

DESCRIPTION

When premix burners may be applied to warm air furnaces designed for use with inshot burners where heat collects at the inlet to the heat exchanger due to differences in flame shape of inshot and premix burners. The present apparatus may solve the heat problem.

The apparatus may cool the front of the heat exchanger by pulling combustion air over the area around the inlet to the heat exchanger.

Figure 1A:
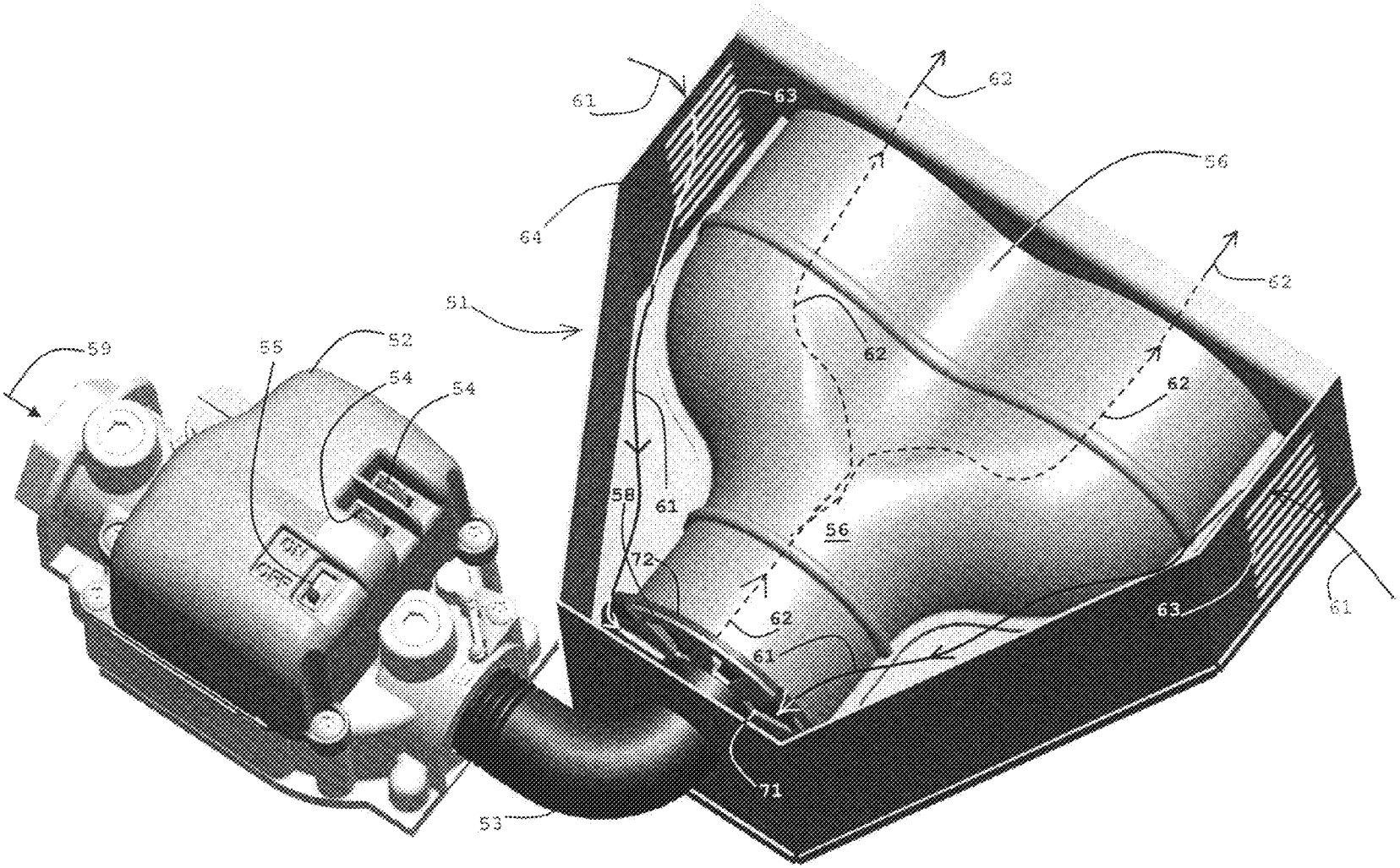
FIG. 1*a* is a diagram of a perspective view of a premix burner apparatus.

FIG. 1*a* is a diagram of a perspective view of a premix burner apparatus 51. A valve 52 may control a fuel 59 coming in from a source to apparatus 51 via a tube or pipe 53. Tube or pipe 53 may be curved or straight. A switch 55 may be turned on or off to open or close valve 52 as long as power is applied to valve 52 at, for instance, terminals 54. An example power source may be about 24 volts AC. A controller 67 (FIG. 7) may indicate when the power is to be applied to terminals 54, particularly if switch 55 is in the "on" position. So controller

67 may control fuel input to apparatus 51 via pipe 53. The amount of fuel provided at first may result in a lean mixture because of the initial receipt of cool air; however, the mixture can become richer as the air warms up with heat from the burner.

Figure 8:
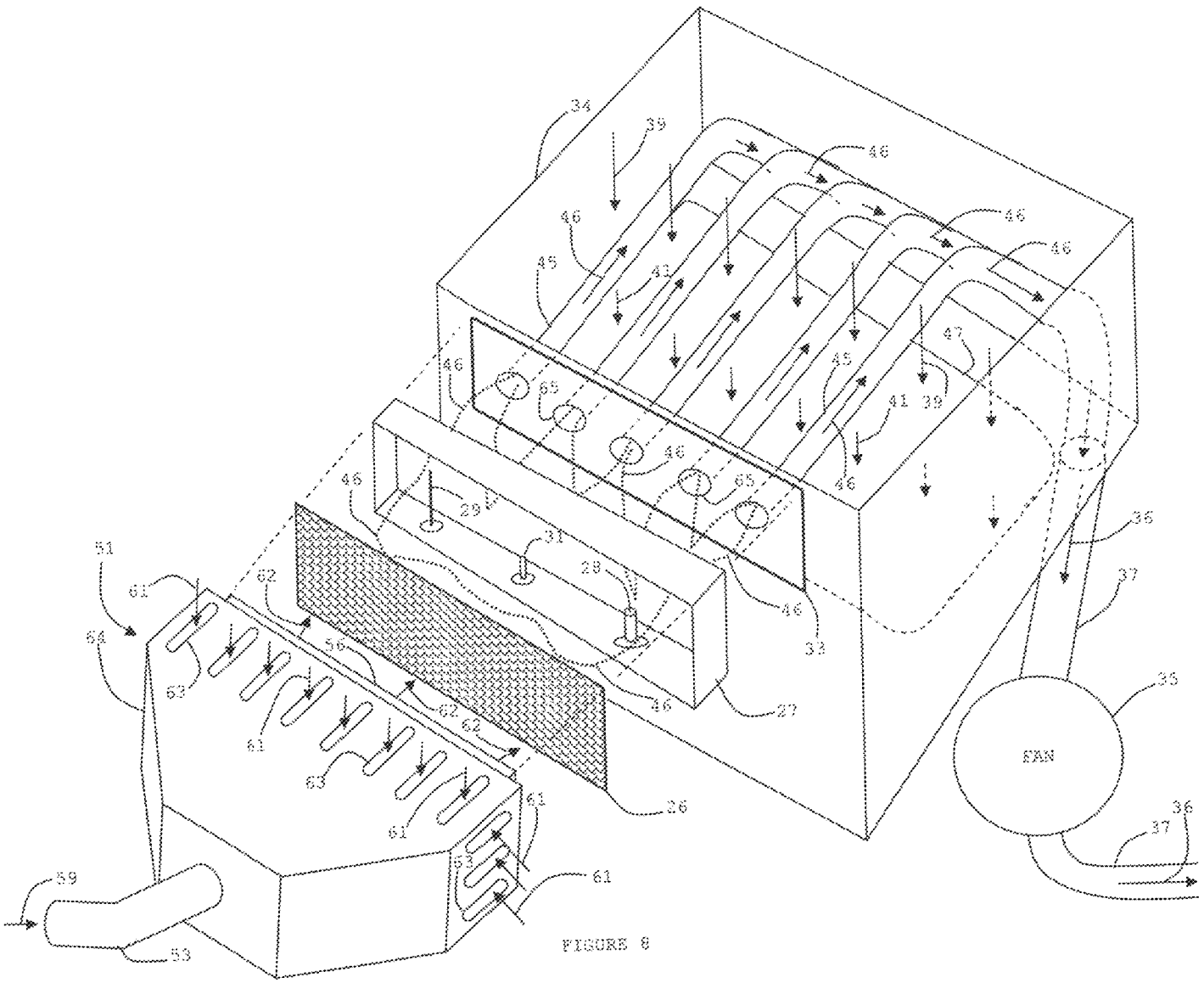
FIG. 8 is a diagram of the assembly like that of FIG. 7 along with an expanded view of associated components.

Fuel 59 may be provided by pipe 53 into a manifold 56. At an entry end of manifold or box 56, where fuel enters from pipe 53, may be a plate 58 having orifices 71 (FIG. 3) for entry of air 61 which mixes with fuel 59 to result in a mixture 62 inside of manifold 56. The size of the orifices may be adjustable in size, but may be fixed for a particular fuel mixture 62 at a center temperature. Mixture 62 may be drawn through manifold 56, inshot holes 66 (FIG. 2*a*), a mat 26, spacer 27 and plate 33 with holes 65, as shown in FIG. 8. Inshot holes 66 and 65 may be aligned with and connected to tubes 45. Tubes 45 may be a part of a heat exchanger 34. Heat exchanger 34 may instead be a clamshell structure with passageways connected to inshot holes, or be a plate or other type of structure with flame receptive connections to the inshot holes. Operation of heat exchange 34 with the latter noted structures may be similar to that of the tube structure. The tube type of structure is an illustrative example of a heat exchanger 34 described herein.

Manifold 56 may be situated within an enclosure 64. Enclosure 64 may have louvers or slots 63 through which air 61 can enter and be pulled through orifices 71 of plate 58 of manifold 56.

Figure 1B:
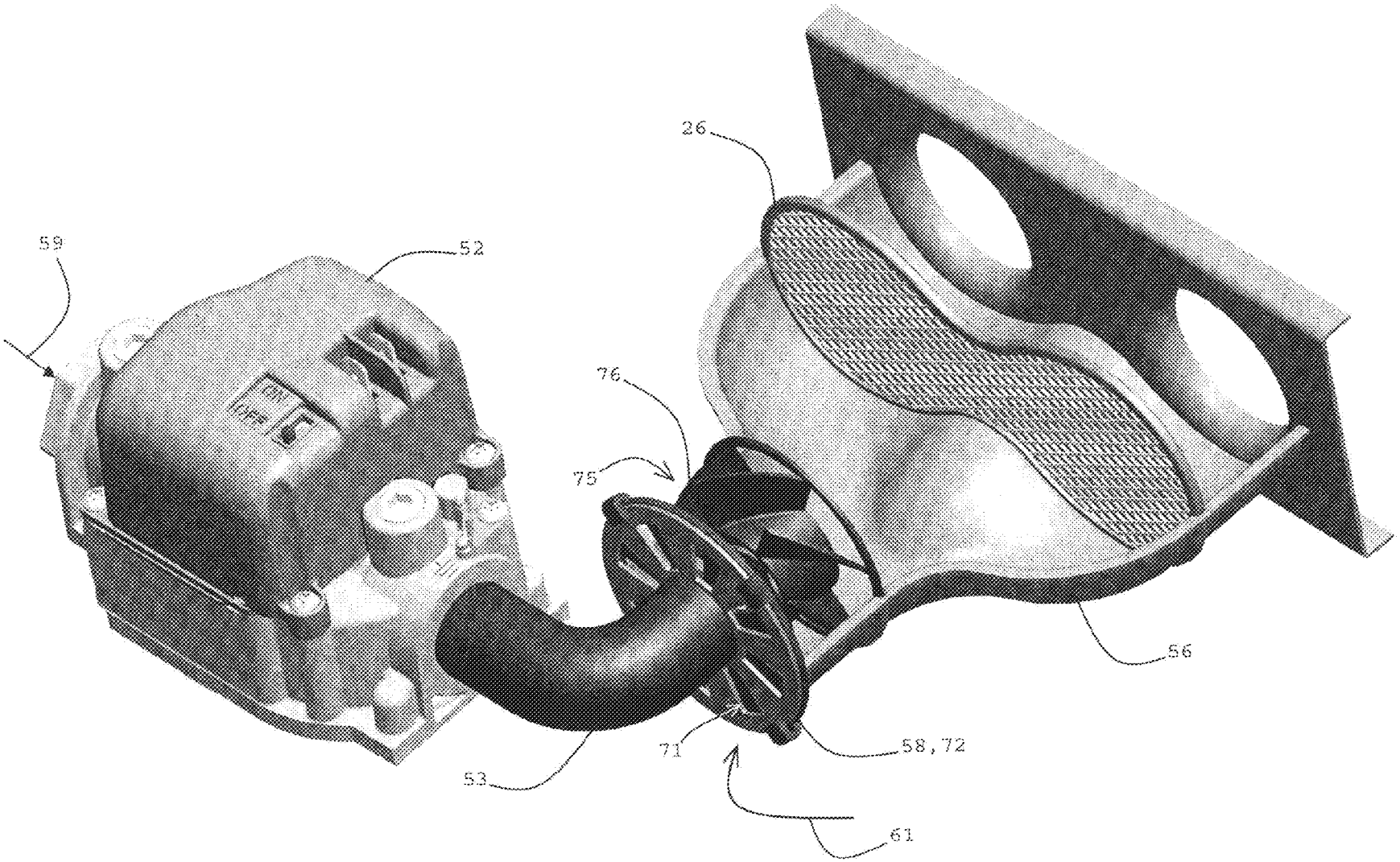
FIG. 1*b* is a diagram of a cutaway of the perspective view of a premix burner apparatus.

FIG. 1*b* is a cutaway view of manifold 56 showing overlapping plates 58 and 72 for providing adjustable orifices 71 for intake of air 61. Fuel 59 may enter manifold 56 from tube 53. A gas-air swirler 75 may be positioned in line with a movement of air 61 and fuel 59. Fuel 59, such as gas, from an orifice may be injected toward a center of swirler 75 at a pressure ranging from about 0.5 inch WC to about 3.5 inches WC. Swirler 75 may reverse the direction of a gas flow and start the gas swirling. The gas may be pulled over an edge of swirler 75 and introduced into a combustion air 61 flow from orifices 71 which may be pulled past outside blades 76 on swirler 75. A resulting gas-air mixture 62 may be transported to and through a burner head 26. Upon passing through burner head 26, mixture 62 may be ignited into a flame 46.

Figure 2A:
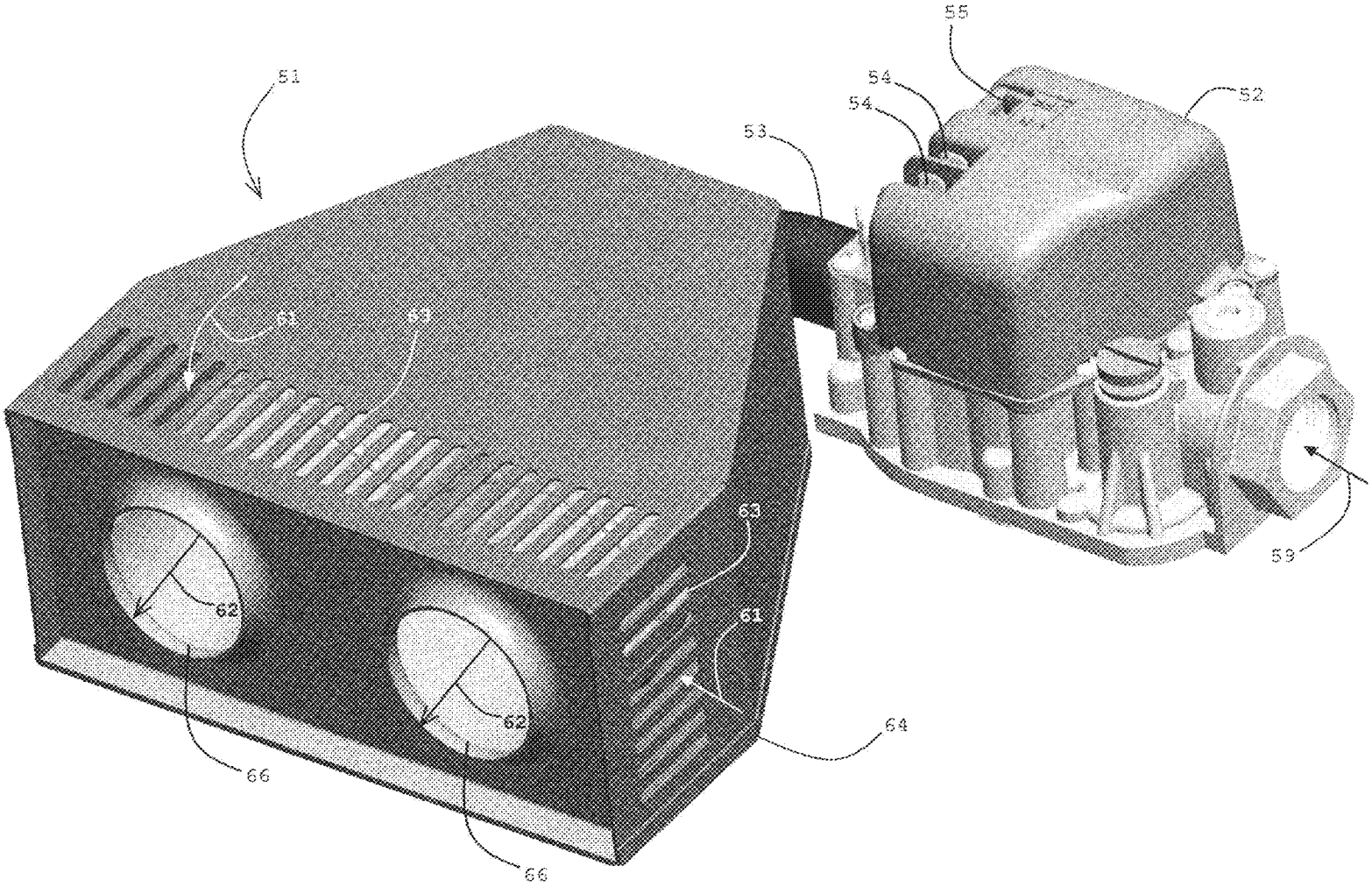
FIG. 2*a* is a diagram of another perspective view of the premix burner apparatus.
Figure 2B:
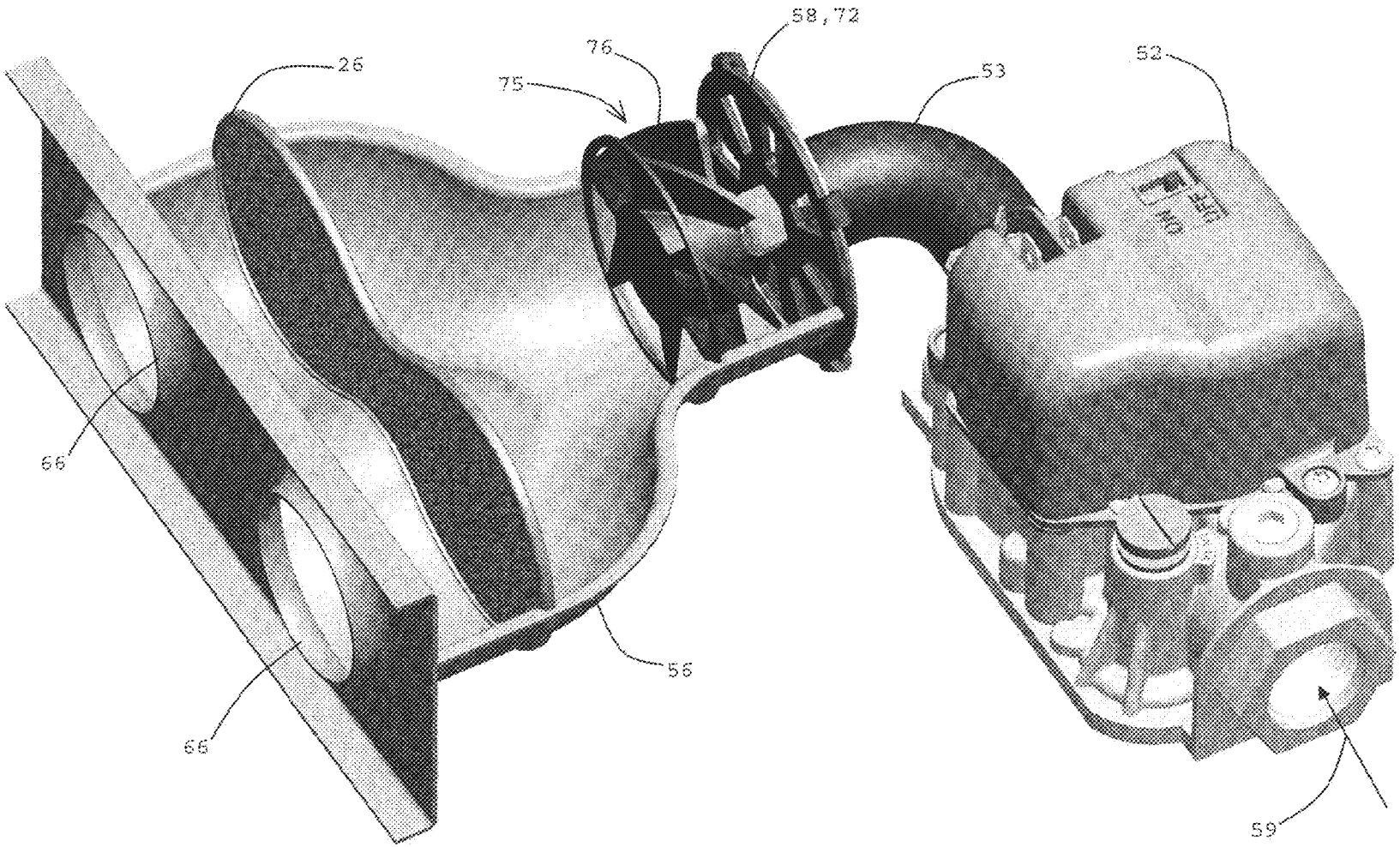
FIG. 2*b* is a diagram of a cutaway of the other perspective view of the premix burner apparatus.

FIG. 2*a* is another diagram of premix burner apparatus 51, showing a mixture 62 that can be output from manifold 56 at inshot holes 66 of enclosure 64. FIG. 2*b* is a cutaway view of manifold 56 from a similar perspective of enclosure 64 in FIG. 2*a*. Enclosure 64 may contain manifold 56.

Figure 3A:
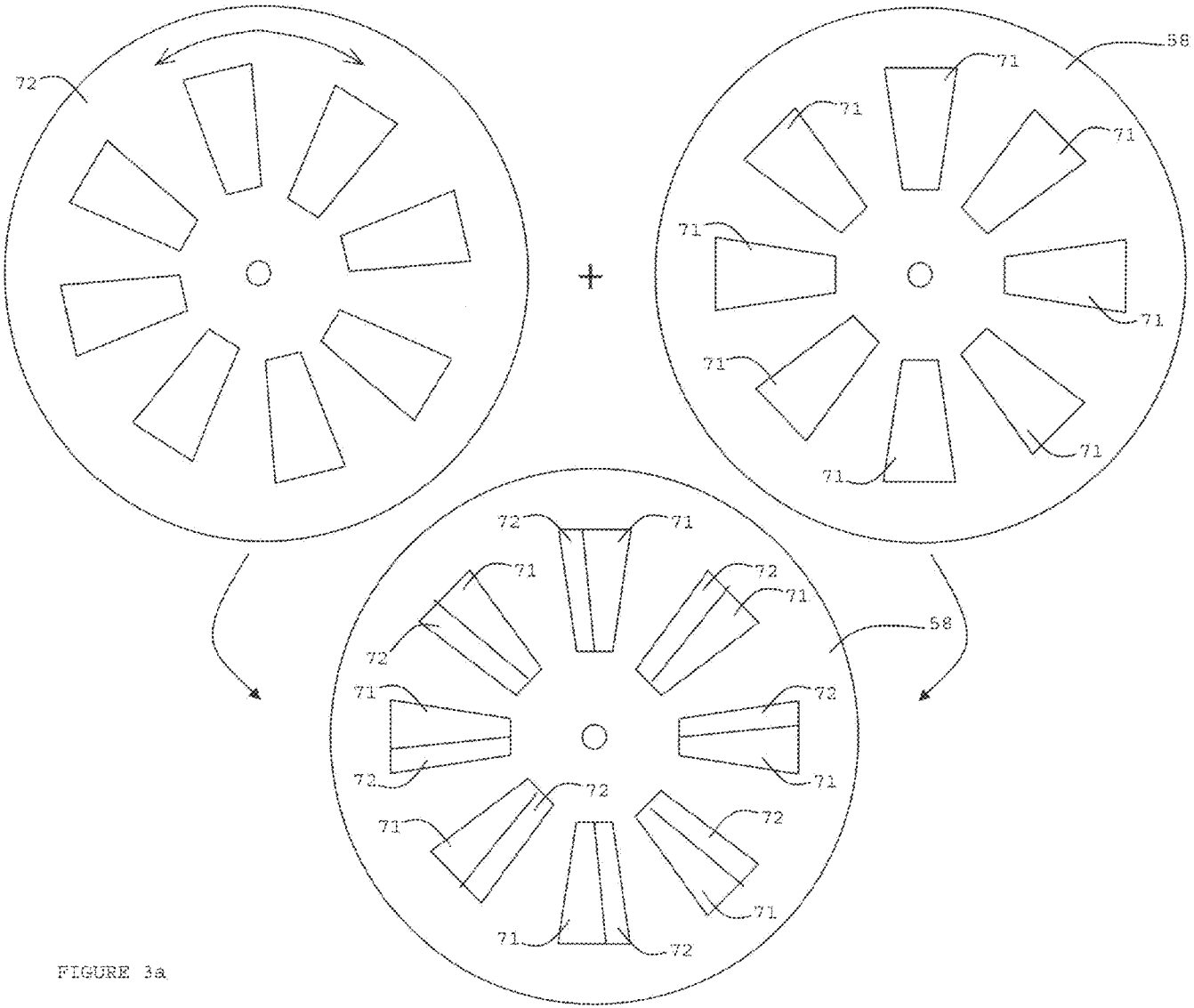
FIG. 3*a* is a diagram of a structure having adjustable orifices for air input to premix burner apparatus.

FIG. 3*a* reveals a structure of plate 58 with orifices 71 having their openings adjusted with a plate 72 which is replication of plate 58, and adjacent and concentric to plate 58. A rotation of plate 72 may vary the openings of orifices 71 from zero to 100 percent. The openings may be adjusted during assembly of the manifold, after assembly of the manifold with a burner and heat exchanger, or during operation of the manifold, burner and heat exchanger. The orifice 71 openings may be manually adjusted for one or multiple times or may be dynamically adjusted (e.g., manually or by a motor connected to controller 67) during operation of manifold 56. Other mechanisms may be utilized in lieu of plates 58 and 72 for adjustment of the opening or openings of the air input to manifold 56.

Figure 3B:
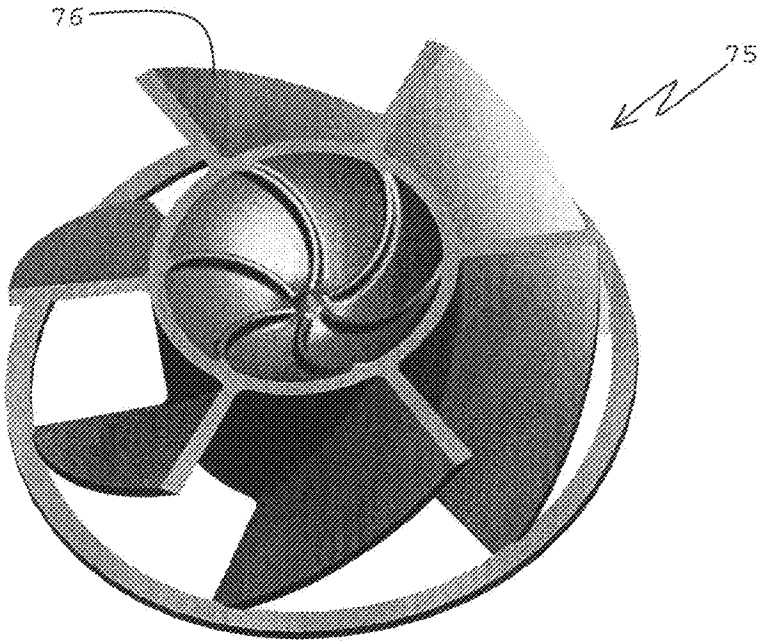
FIG. 3*b* is a diagram of a swirler.

FIG. 3*b* is a diagram of an example swirler 75 with blades 76. Swirler 75 may have different shapes and designs. Swirler 75 may be fixed or stationary as opposed to being rotatable or rotated, although the latter approaches are possible options.

Figure 4:
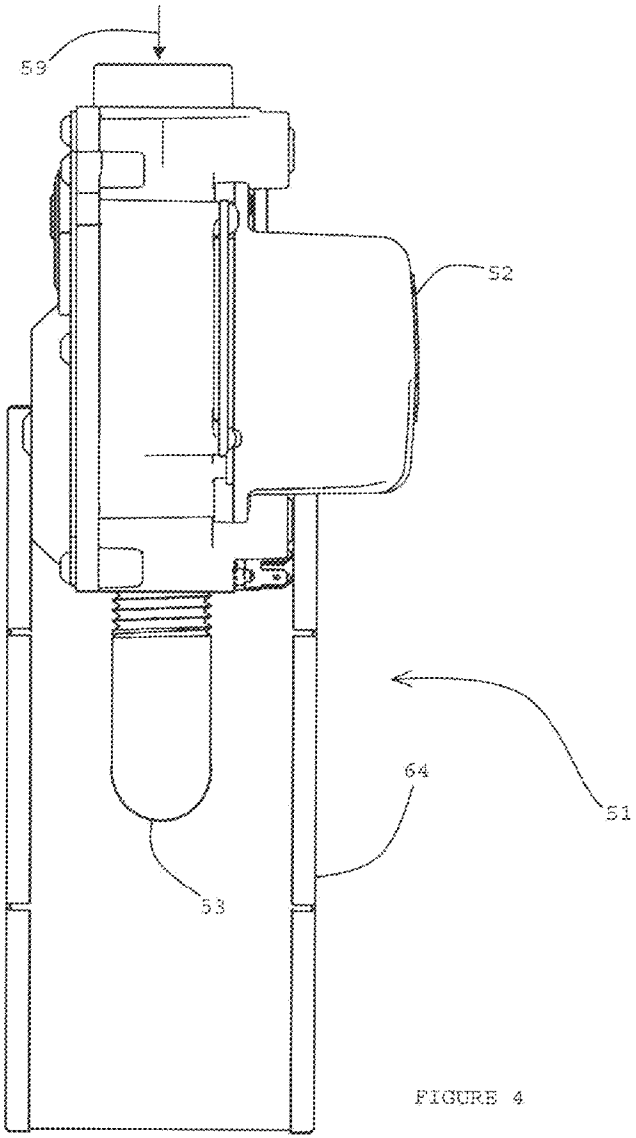
FIG. 4 is a diagram of a back view of the premix burner apparatus.
Figure 5:
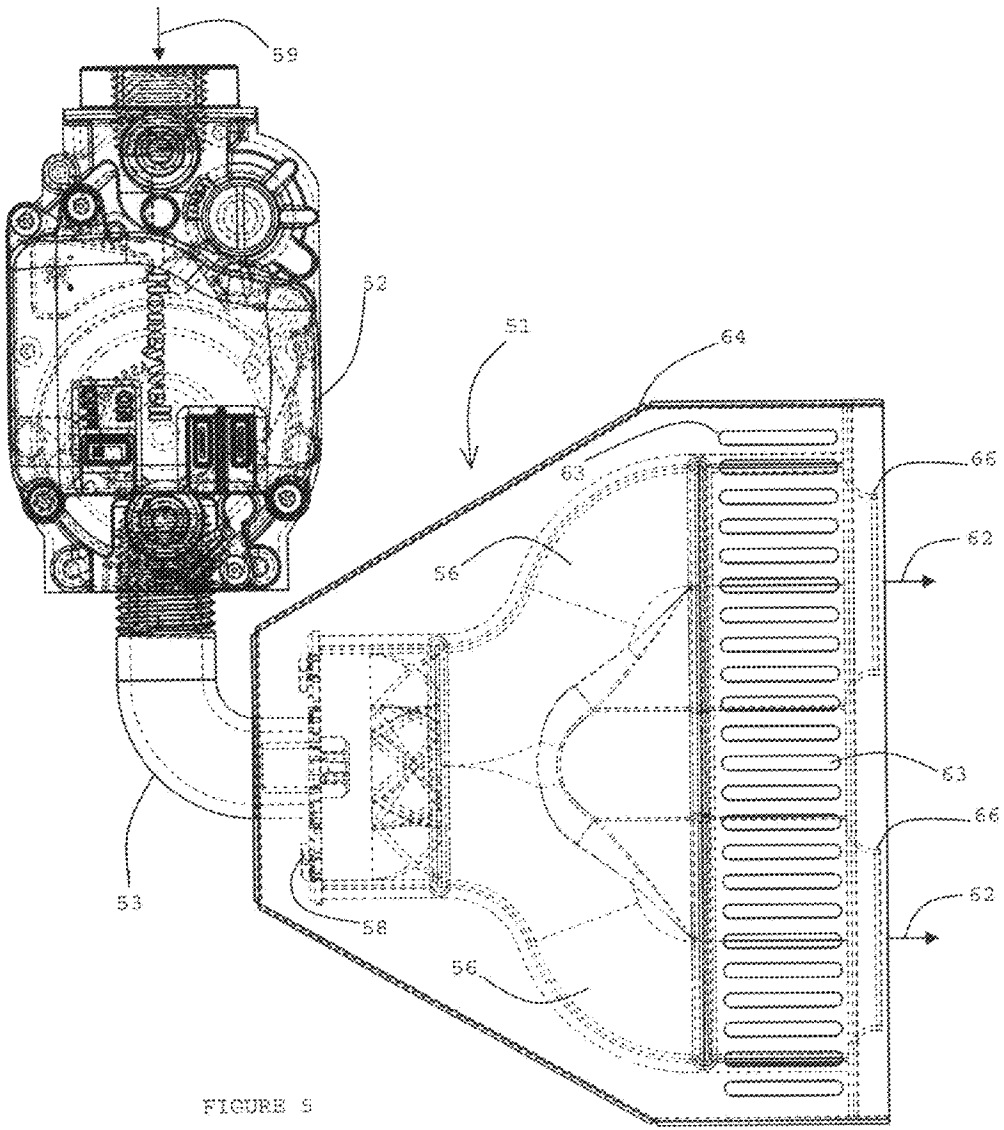
FIG. 5 is a diagram of a top view of the premix burner apparatus.
Figure 6:
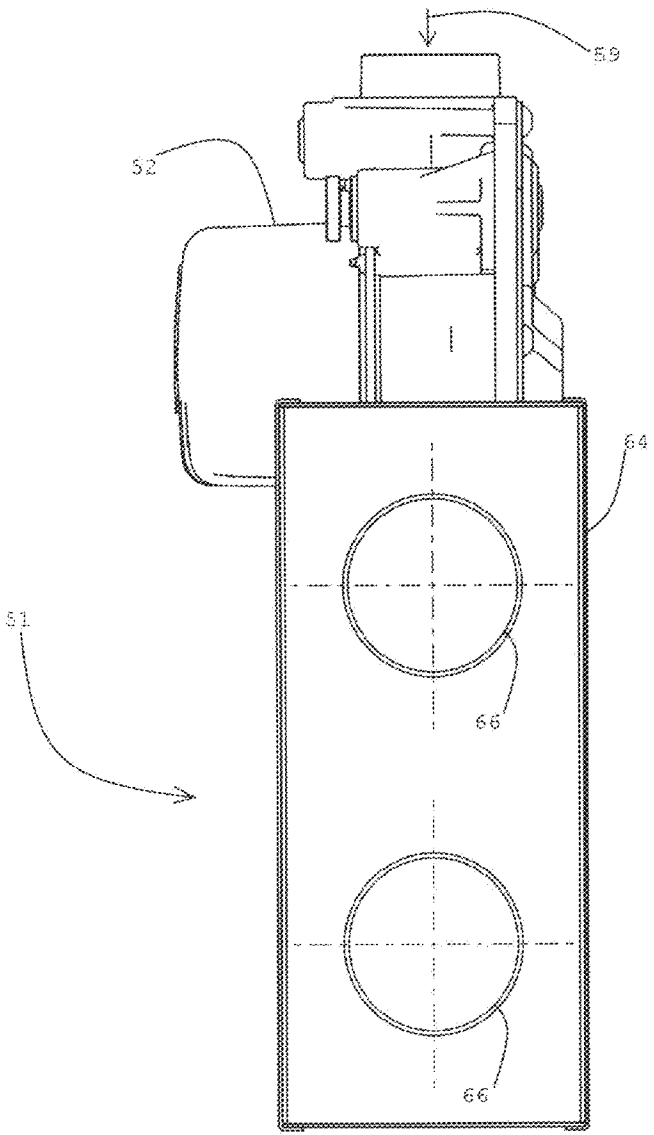
FIG. 6 is a diagram of a front view of the premix burner apparatus.

FIG. 4 is a diagram of a back view of apparatus 51 facing the fuel entry end of enclosure 64 via pipe 53. Valve control 52 may also be at the forefront of this view. If apparatus 51 is rotated 90 degrees clockwise about an axis looking down at and coinciding with the fuel 59 entry arrow, another view of apparatus 51 may appear as shown in a diagram of FIG. 5. The diagram may be regarded as a top view of apparatus 51. Positions of valve 52, pipe 53, plate 58, manifold 56, enclosure 64, louvers 63 and inshot holes 66 may be revealed relative to one another. If apparatus 51 is rotated another 90 degrees clockwise about the axis looking down at and coinciding with the fuel 59 entry arrow, still another view of apparatus 51 in a diagram of FIG. 6 may be revealed. The diagram may be regarded as a front view of apparatus 51 with enclosure 64 revealing inshot holes 66. Valve 52 is shown behind enclosure 64. It may be noted that there can be more than two inshot holes 66.

Figure 7:
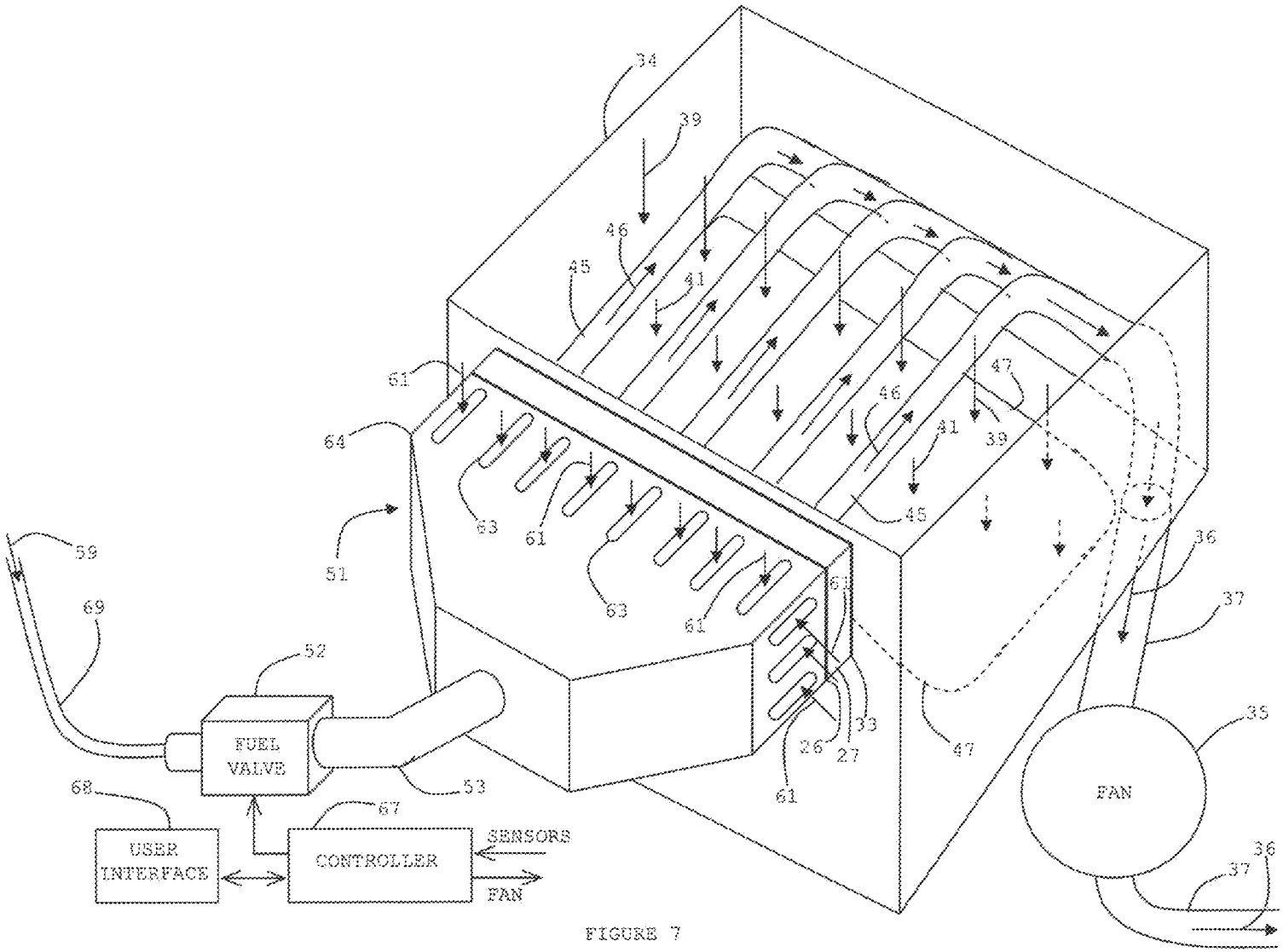
FIG. 7 is a diagram of the premix burner assembly attached to a heat exchanger.

FIG. 7 is a diagram of heat exchanger 34 and the premix burner assembly 51 attached to exchanger 34. Air 61 may go through louvers or slots 63 of housing 64. Once inside of housing 64, air 61 may flow over a surface of manifold 56 from a front end, where inshot holes 66 are situated, to a back end where plate 58 with orifices 71 that receive air 61 which enters manifold 56 and mixes with fuel 59 from pipe 53 into a fuel and air mixture 62, as shown in FIG. 1.

The diagram of FIG. 7 also shows a line or pipe 69 coupled to fuel valve 52, which may control a flow of fuel 59 through pipe 53 to manifold 56 to be mixed with air 61. A controller 67 may be connected to gas fuel valve 52 for controlling fuel flow. Controller 67 may also be connected to a user interface 68. There may be information provided to controller 67 from various sensors in heat exchanger 34, a spacer 27, assembly 51 and/or other locations. An output from controller 67 may be connected to a fan 35 for control of the fan, including it speed.

Mixture 62 may be drawn from inshot holes 66 through a burner head 26, which may be a layer such as a mesh, fiber mat, or woven or knit fibers, after which the mixture can be ignited into a flame 46. Burner head 26 may be situated within manifold 56 (FIGS. 1*a*-2*b*) inside of enclosure 64, or burner head 26 may be situated at or proximate to the output end of manifold 56. Burner head 26 may be one of various shapes such as square, round, oval, or other shape, so as to fit someplace in the manifold, at the output of the manifold, or other location according to a desired design.

The flame may be drawn through a front burner spacer 27 and an orifice shield 33. The flame may be further drawn in as separate flames 46 through tubes 45 of heat exchanger 34. A circulating blower (not shown) may pull in return air 39 and push the air by hot tubes 45 to result in heated air 41 which exits the exchange port out of a port 47 to various vents or the like for heating a space or spaces.

Flames 46 in tubes 45 may result in burnt gases 36 which are drawn out through flue 37 by fan 35. Fan 35 may be an induced draft blower. Fan 35 may be modulated or varied in speed by controller 67. Fan 35 may force much flue gas 36 out of the system via flue 37 to the outside.

FIG. 8 is a diagram of the burner system like that of FIG. 7 except an expanded view of the burner components is shown. Mixture 62 may be provided by apparatus 51 from inshot holes 66 through burner head 26 or through the burner head 26 and with a flame to inshot holes 66. Once a mixture 62 passes through burner head 26, the mixture may be ignited by an igniter 28 in the burner front spacer 27, to result in a flame 46. Burner front spacer 27 may also have a flame detector 29 and a temperature sensor 31. Information from detector 29 and/or sensor 31 may go to controller 67. In some situations, a flame detector 29, with an appropriate structure may also operate as an igniter of mixture 62. Flame 46 may be drawn to an orifice shield 33 having inshot holes 65 for flame entry into the respective tubes 45. Individual flames 46 may be drawn through tubes 45, for providing heated air 41, as noted herein.

The mat or screen of burner head 26 may be a permeable structure that resembles steel wool. Burner head 26 may be virtually always present somewhere in the burner system.

Burner head 26 may be a FeCrAl alloy fiber layer, such as a mat, weave, or knit of fibers, strands, wires, or the like. The layer does not necessarily have features to shape or distribute the flame and does not necessarily require any supporting substrate. The fibers, strands, or wire-like materials may have about a 0.009 inch diameter, but may have other diameters. Other shapes of the layer material may be used. Other materials may incorporate Kanthal™, Fecralloy™, and the like. Even non-metal fibers or wires may be used. The material of fibers, strands, wires and the like should be able to withstand temperatures greater than 1800 degrees F.

Burner design may consist of one burner head for all of the heat exchanger sections as opposed individual burners within or for each heat exchanger section. There may instead be a burner header for each sub-group of sections.

A FeCrAl alloy fiber layer, as an example, may create a very small pressure drop of in the range of 0.2-0.5" WC. Nominal thickness of the layer may range between 0.01 and 0.10. An example thickness may be 0.035". A flame may be shaped by a negative pressure created by an induced draft blower drawing the flame and combustion products through the orifice shield and heat exchanger. The burner head may be spaced away from the heat exchanger by a burner front spacer which can also contain the igniter, flame sensor and viewport. The igniter may be a hot surface or direct spark. The direct spark version may use a single rod for ignition and flame sensing. A temperature sensor may be used to detect unsafe or abnormal operating conditions of the burner.

The present system and approach, as described herein and/or shown in the Figures, may incorporate one or more processors, computers, controllers, user interfaces, wireless and/or wire connections, and/or the like, wherever desired.

To recap, a pre-mix burner system may incorporate a manifold having an air input, a fuel input and a mixture output, and a housing enclosing the manifold. The housing may have one or more air input slots, an input opening for the fuel input to the manifold, and an output opening for the mixture output of the manifold. A path for a flow of air may go through the one or more input slots proximate to an output portion of the manifold, over an external surface of the manifold from the output portion of the manifold to the air input at an input portion of the manifold. The flow of air following the path may be for changing a temperature of the manifold and/or the air of the flow to the air input of the manifold. The flow of air following the path may be for lowering the temperature of the manifold.

A swirler may be situated in the manifold proximate to the air and fuel inputs. The swirler may be for mixing air and fuel from the air and fuel inputs into a gas-air mixture.

The air of the flow to the air input of the manifold and into the manifold may further be for mixing with a fuel in the manifold from the fuel input of the manifold to result in a mixture of the air and fuel. The mixture output of the manifold may be for a drawing out the mixture of the air and fuel.

The system may further incorporate a burner attached to the mixture output of the manifold. The burner may be for igniting the mixture drawn from the mixture output of the manifold into a flame.

The system may further incorporate a heat exchanger having a clamshell, tube, plate or other type of structure. The heat exchanger with the clamshell structure may have one or more passageways for a flame. The heat exchanger with the tube structure may have one or more tubes for a flame. The one or more tubes or passageways may be for conveying a drawn-in flame and heating the one or more tubes or passageways. Alternatively, the heat exchanger may have two or more tubes or passageways.

The system may further incorporate an air mover for drawing air in through the one or more input slots, drawing the air over the external surface of the manifold, through the input of the manifold and the manifold where the air is for mixing with the fuel into the mixture, drawing the mixture into the burner where the mixture is ignited into a flame, drawing the flame through the one or more tubes, and drawing exhaust gases from the one or more tubes.

The system may further incorporate a valve connected to the fuel input, a controller connected to the fuel input and the air mover, and one or more sensors situated in the manifold. The burner may be connected to the controller.

An approach for affecting a temperature of a manifold may incorporate drawing first air through one or more openings of a housing into the housing and over a surface of a pre-mix burner manifold, further drawing the first air through an input of the manifold and into the manifold, drawing fuel into the manifold for obtaining an air and fuel mixture, and drawing the air and fuel mixture out of the manifold through one or more inshot holes into a burner. The first air drawn over the surface of the manifold may be for changing the temperature of the manifold and/or the air.

The approach may further incorporate igniting the air and fuel mixture in the burner into a flame, drawing the flame into one or more tubes aligned with the one or more inshot holes, and drawing the flame through the one or more tubes to heat up the tubes.

The approach may further incorporate pulling second air over the one or more tubes to draw heat from the one or more tubes to warm up the second air. The approach may further incorporate pulling the second air from over the one or more tubes into a space for temperature control of the space. The approach may further incorporate drawing an exhaust of burnt air and fuel mixture from the tubes with an air mover.

There may be two or more inshot holes and two or more tubes. The approach may further incorporate pulling the second air from over the two or more tubes into a space for temperature control of the space.

A premix burner manifold may incorporate a manifold having an input port and one or more output ports, a fuel connection at the input port, an air input at the input port, and a housing, having one or more input slots, enclosing the manifold having the input port and output ports.

Air may be drawn through the one or more slots into the housing, over the manifold, through the input port, and through the manifold and the one or more output ports. The fuel connection may permit fuel to be provided into the manifold to form a mixture with the air drawn through the manifold.

The manifold may further incorporate a burner coupled to the one or more output ports, and an igniter situated in the burner. The manifold may further incorporate a heat exchanger having one or more tubes connected to the burner, and a first air moving mechanism connected to the tubes. The first air moving mechanism may draw the air into the housing and the manifold, the fuel and air mixture through the manifold and into the burner to be ignited as a flame, and the flame through the tubes.

The manifold may further incorporate a second air moving mechanism connected to the heat exchanger. The second air moving mechanism may pull air across the tubes to obtain heated air. There may be two or more output ports and two or more tubes.

The present apparatus may relate to technology disclosed in U.S. Pat. No. 6,923,643, issued Aug. 2, 2005, and entitled "Premix Burner for Warm Air Furnace", and in U.S. Pat. No. 6,880,548, issued Apr. 19, 2005, and entitled "Warm Air Furnace with Premix Burner". U.S. Pat. No. 6,923,643, issued Aug. 2, 2005, is hereby incorporated by reference. U.S. Pat. No. 6,880,548, issued Apr. 19, 2005, is hereby incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A pre-mix burner system comprising:

a manifold having an air input, a fuel input and a mixture output; and a housing enclosing the manifold; and wherein:

the housing has one or more air input slots, an input opening for the fuel input to the manifold, and an output opening for the mixture output of the manifold;

a path for a flow of air goes through the one or more input slots proximate to an output portion of the manifold, over an external surface of the manifold from the output portion of the manifold to the air input at an input portion of the manifold; and the flow of air following the path is for changing a temperature of the manifold and/or the air of the flow to the air input of the manifold.

2. The system of claim 1, further comprising:

a swirler situated in the manifold proximate to the air and fuel inputs; and wherein the swirler is for mixing air and fuel from the air and fuel inputs.

3. The system of claim 1, wherein the flow of air following the path is for lowering the temperature of the manifold.

4. The system of claim 1, wherein:

air of the flow of air to the air input of the manifold and into the manifold is further for mixing with a fuel in the manifold from the fuel input of the manifold to result in a mixture of the air and fuel; and the mixture output of the manifold is for a drawing out the mixture of the air and fuel.

5. The system of claim 4, further comprising:

a burner attached to the mixture output of the manifold; and the burner is for igniting the mixture drawn from the mixture output of the manifold into a flame.

6. The system of claim 5, further comprising:

a heat exchanger having a clamshell or tube structure; and wherein:

the structure has one or more paths; and the one or more paths are for conveying a drawn-in flame and heating the structure.

7. The system of claim 6, wherein the heat exchanger has two or more paths.

8. The system of claim 6, further comprising an air mover for drawing air in through the one or more input slots, drawing the air over the external surface of the manifold, through the input of the manifold and the manifold where the air is for mixing with the fuel into the mixture, drawing the mixture into the burner where the mixture is ignited into a flame, drawing the flame through the one or more paths, and drawing exhaust gases from the one or more paths.

9. The system of claim 8, further comprising:

a valve connected to the fuel input;

a controller connected to the fuel input and the air mover; and one or more sensors situated in the manifold; and wherein the burner is connected to the controller.

10. An approach for affecting a temperature of a manifold, comprising:

drawing a first air through one or more openings of a housing into the housing and over a surface of a pre-mix burner manifold;

further drawing the first air through an input of the manifold and into the manifold;

drawing fuel into the manifold for obtaining an air and fuel mixture; and drawing the air and fuel mixture through the manifold and one or more inshot holes to a burner; and wherein the first air drawn over the surface of the manifold is for changing the temperature of the manifold and/or the air and fuel mixture.

11. The approach of claim 10, further comprising:

igniting the air and fuel mixture in the burner into a flame;

drawing the flame into one or more tubes aligned with the one or more inshot holes; and drawing the flame through the one or more tubes to heat up the tubes.

12. The approach of claim 11, further comprising pulling a second air over the one or more tubes to draw heat from the one or more tubes to warm up the second air.

13. The approach of claim 12, further comprising pulling the second air from over the one or more tubes into a space for temperature control of the space.

14. The approach of claim 12, further comprising drawing an exhaust of burnt air and fuel mixture from the tubes with an air mover.

15. The approach of claim 10, further comprising:

igniting the air and fuel mixture in the burner into a flame;

drawing the flame into two or more tubes aligned with the two or more inshot holes;

drawing the flame through the two or more tubes to heat up the tubes;

pulling a second air over the two or more tubes to draw heat from the two or more tubes to warm up the second air; and pulling the second air from over the two or more tubes into a space for temperature control of the space.

16. A premix burner manifold comprising:

a manifold having an input port and one or more output ports;

a fuel connection at the input port;

an air input at the input port;

a housing, having one or more input slots, enclosing the manifold having the input port and output ports; and wherein:

air can be drawn through the one or more slots into the housing, over the manifold, through the input port, and through the manifold and the one or more output ports; and the fuel connection permits fuel to be provided into the manifold to form a mixture with the air drawn through the manifold.

17. The manifold of claim 16, further comprising:

a burner coupled to the one or more output ports; and an igniter situated in the burner.

18. The manifold of claim 17, further comprising:

a heat exchanger having one or more tubes connected to the burner; and a first air moving mechanism connected to the tubes; and wherein the first air moving mechanism draws the air into the housing and the manifold, the fuel and air mixture through the manifold and into the burner to be ignited as a flame, and the flame through the tubes.

19. The manifold of claim 18, further comprising:

a second air moving mechanism connected to the heat exchanger; and wherein the second air moving mechanism pulls air across the tubes to obtain heated air.

20. The manifold of claim 18, wherein there are two or more output ports and two or more tubes.

* * * * *